United States Patent [19]

Nanyoshi et al.

[11] Patent Number: 4,971,011

[45] Date of Patent: Nov. 20, 1990

[54] AIR AND FUEL CONTROL SYSTEM FOR INTERNAL COMBUSTION ENGINE

[75] Inventors: Yasutoshi Nanyoshi, Akashi; Hideo Nakamura, Yokosuka, both of Japan

[73] Assignee: Nissan Motor Co., Ltd., Yokohama, Japan

[21] Appl. No.: 457,473

[22] Filed: Jan. 2, 1990

[30] Foreign Application Priority Data

Jan. 6, 1989 [JP] Japan ..... 64-554
Jan. 9, 1989 [JP] Japan ..... 1-1281
Feb. 13, 1989 [JP] Japan ..... 1-31218

[51] Int. Cl.[5] ..... F02M 7/00

[52] U.S. Cl. ..... 123/436; 123/492; 123/419

[58] Field of Search ..... 123/436, 488, 492, 489, 123/478, 480, 493, 494

[56] References Cited

U.S. PATENT DOCUMENTS 4,487,186 12/1984 Wahl et al. ..... 123/436
4,489,690 12/1984 Burkal et al. ..... 123/419
4,674,459 6/1987 Blochar et al. ..... 123/436
4,712,529 12/1987 Terasaka et al. ..... 123/492
4,788,489 11/1988 Kobayashi et al. ..... 324/61 P
4,883,038 11/1989 Nakaniwa ..... 123/436

*Primary Examiner*—Raymond A. Neill
*Attorney, Agent, or Firm*—Foley & Lardner, Schwartz, Jeffery, Schwaab, Mack, Blumenthal & Evans

[57] ABSTRACT

In order to compensate for the effect of a by-pass passage which by-passes air about the engine throttle valve when a predetermined vacuum prevails downstream thereof, or the delay in air flow within the induction system in response to the demand for engine power, a target torque value is derived based on the engine speed and the accelerator pedal depression amount and this value is used in connection with one or both of the fuel supply and the air flow control. In some embodiments two basic injection pulses are developed and one is selected to suit the instant induction conditions. In other embodiments, selectively delayed target torque values are used to individually modify the throttle valve control and injection fuel supply amount.

14 Claims, 13 Drawing Sheets

AIR AND FUEL CONTROL SYSTEM FOR INTERNAL COMBUSTION ENGINE

BACKGROUND OF THE INVENTION

1. Field of the Invention

The present invention relates generally to a control system for internal combustion engines and more specifically to an engine control system which controls the air induction and increases the fuel supply precision in a manner which improves the engine control and response characteristics.

2. Description of the Prior Art

JP-A-58-155235 discloses an example of an engine control system wherein a target torque value is set in accordance with the engine speed and the degree of accelerator pedal depression. In accordance with the target torque which is derived, this system controls the operation of a servo which controls the position of the engine throttle valve and also controls the amount of fuel supplied based on air induction amount as indicated by either the output of an air-flow meter or an induction pressure sensor.

However, this system has suffered from the drawback that, as the system is primarily controlled by the controlling the amount of air inducted and the fuel supply derived following the air flow derivation, during transitional periods, the delay in the response which is inherent with the sensors involved, has rendered it very difficult to maintain the required fuel supply precision or accuracy.

SUMMARY OF THE INVENTION

In an attempt to overcome this problem it was proposed in Japanese Patent Application No. 63-144797 (published as JP-A-1-313636) by the same entity as the instant application is assigned, to combine the two controls in a manner wherein the induction volume necessary to achieve the target torque for the instant engine speed is determined. Using this induction value a target throttle valve opening is determined and a throttle valve control servo operated accordingly. The fuel supply amount is controlled in accordance with the target torque value.

That is to say, the air induction amount is calculated and based on this value the throttle opening and the fuel supply amount are derived. However, in the event that the engine is operating under low load conditions and the throttle valve opening is small, a relatively high vacuum develops downstream of the throttle valve and some of the air which is inducted into the engine is by-passed around the throttle valve by way of the by-pass passage provided to facilitate engine idling control. As a result of this by-passing, the total amount of air which is inducted is larger than that which is indicated by the relatively small throttle opening. In other words, the amount of air inducted is no longer proportional to the throttle opening and causes the fuel supply control to deviate in a manner which deteriorates the air-fuel ratio control.

Further, in the event that the engine is fitted with a turbocharger or similar type of supercharging device, as the supercharging pressure does not vary in precise synchronism with the accelerator pedal depression degree, it is not possible to obtain the required accuracy by basing the air and fuel controls simply on the engine throttle position.

Accordingly, it is an object of the present invention to provide a control system which enables the amount of fuel which is supplied to the engine be controlled on the basis of a target torque value which is derived based on the demand for power as indicated by the amount of accelerator pedal depression and engine speed (for example) and to control the amount of air which is supplied to the engine using a technique which takes the construction and characteristics of the induction system into account.

In brief, the above object is achieved by an arrangement wherein in order to compensate for the effect of a by-pass passage which by-passes air about the engine throttle valve when a predetermined vacuum prevails downstream thereof, or delay in air flow response within the induction system in response to the demand for engine power, a target torque value is derived based on the engine speed and the accelerator pedal depression amount and this value is used in connection with one or both of the fuel supply and the air flow control. In some embodiments two basic injection pulses are developed and one is selected to suit the instant induction conditions. In others, selectively delayed target torque values are used to individually modify the throttle valve control and injection fuel supply amount.

More specifically, a first aspect of the present invention is deemed to comprise an internal combustion engine control system which features: an engine speed sensor; accelerator pedal depression sensor; target torque determining means responsive to said engine speed sensor and said accelerator pedal depression sensor for determining a target torque value; air induction control means responsive to said target torque determining means for controlling the amount of air inducted into said engine; means for determining a first basic fuel supply amount based on the target torque value; an air induction sensor for sensing the amount of air inducted into the engine; means responsive to the air induction sensor for determining a second basic fuel supply amount; selection means for selecting one of the first and second basic fuel supply amounts; and fuel supply means for supplying the selected fuel supply amount to the engine.

A second aspect of the present invention is deemed to comprise an internal combustion engine control system for an engine having an induction system, which features: an engine speed sensor; accelerator pedal depression sensor; first means responsive to said engine speed sensor and said accelerator pedal depression sensor for determining a target torque value; means for determining an air induction delay factor based on the engine speed, the target torque value and the induction characteristics of the engine induction system; means for determining a first modified target torque value which represents the torque which can actually be produced by the engine based on the target torque value and the air induction delay factor; means responsive to the first modified torque target value for controlling the amount of fuel supplied to the engine; means for producing a delayed target torque value, said delayed target torque value comprising said target torque value which is issued with a delay of a time defined between the timing of the supply of fuel to the engine and the induction phase; and air induction control means for controlling the amount of air which is inducted into the engine in response to said delayed target torque value producing means.

A third aspect of the present invention is deemed to comprise an internal combustion engine which features: means for determining the engine speed and the amount depression of an accelerator pedal; means for determining a target torque value based on the engine speed and accelerator pedal depression; means for determining a delay in the induction air flow which will occur in based on said target torque value; means for modifying the target torque value using the determined delay and developing a modified torque value which represents the amount of torque which can actually be expected to be produced by the engine in view of the air flow delay; means for controlling the fuel supply based on the modified torque value; and means for controlling the air flow based on a value of the target torque which was recorded a predetermined time before.

A fourth aspect of the present invention is deemed to comprise an internal combustion engine having a throttle valve and fuel supply means: means for sampling the engine speed and the amount depression of an accelerator pedal at predetermined intervals; means for determining a target torque value based on the engine speed and accelerator pedal depression samples; means for recording the target torque values; means for using the target torque which was recorded one sampling period before as a modified target torque value; means for controlling the fuel supply based on the modified torque value; means for using a target torque value which was recorded a plurality of sampling periods before as a delayed target torque value; and means for controlling the position of said throttle valve in accordance with said delayed target torque.

A fifth aspect of the present invention is deemed to comprise an internal combustion engine which features: means for determining the engine speed and the amount depression of an accelerator pedal; means for determining a target torque value based on the engine speed and accelerator pedal depression; means for determining a delay in the induction air flow which will occur based on said target torque value; means for modifying the target torque value using the determined delay and developing a modified torque value which represents the amount of torque which can actually be expected to be produced by the engine in view of the air flow delay; means for controlling the fuel supply based on the modified torque value; means for modifying the target torque value with a time factor so as to develop a delayed target torque value; and means for controlling the position of the throttle valve in accordance with the delayed target torque value.

A sixth aspect of the present invention is deemed to comprise a method of controlling an internal combustion engine, the steps of: determining the engine speed and the amount depression of an accelerator pedal; determining a target torque value based on the engine speed and accelerator pedal depression; determining a delay in the induction air flow which will occur in based on said target torque value; modifying the target torque value using the determined delay and developing a modified torque value which represents the amount of torque which can actually be expected to be produced by the engine in view of the air flow delay; controlling the fuel supply based on the modified torque value; and controlling the air flow based on a value of the target torque which was recorded a predetermined time before.

A seventh aspect of the present invention is deemed to comprise a method of controlling an internal combustion engine having a throttle valve and fuel supply means, the method featuring the steps of: sampling the engine speed and the amount depression of an accelerator pedal at predetermined intervals; determining a target torque value based on the engine speed and accelerator pedal depression samples; recording the target torque values; using the target torque which was recorded one sampling period before as a modified target torque value; controlling the fuel supply based on the modified torque value; using a target torque value which was recorded a plurality of sampling periods before as a delayed target torque value; and controlling the position of said throttle valve in accordance with said delayed target torque.

An eighth aspect of the present invention is deemed to comprise a method of controlling an internal combustion engine, which features the steps of: determining the engine speed and the amount depression of n accelerator pedal; determining a target torque value based on the engine speed and accelerator pedal depression; determining a delay in the induction air flow which will occur based on said target torque value; modifying the target torque value using the determined delay and developing a modified torque value which represents the amount of torque which can actually be expected to be produced by the engine in view of the air flow delay; controlling the fuel supply based on the modified torque value; modifying the target torque value with a time factor so as to develop a delayed target torque value; and controlling the position of the throttle valve in accordance with the delayed target torque value.

A ninth aspect of the present invention is deemed to comprise a method of controlling an internal combustion engine, which features the steps of: sensing engine speed; sensing the amount of depression of an accelerator pedal; determining a target torque value based on the sensed engine speed and accelerator pedal depression amount; determining a first basic fuel supply amount based on the target torque; sensing an induction parameter which varies with the amount of air being inducted into the engine; determining a second basic fuel supply amount based on the sensed parameter; and selecting one of said first and second basic fuel supply amounts based on one of: a combination of the engine speed and the target torque, and a magnitude of said induction parameter.

A tenth and generally generic aspect of the present invention is deemed to comprise an internal combustion engine control system which features: an induction passage; an engine throttle valve disposed in said induction passage for controlling the flow of air therethrough; an engine speed sensor; accelerator pedal depression sensor; target torque determining means responsive to said engine speed sensor and said accelerator pedal depression sensor for determining a target torque value; air induction control means responsive to said target torque determining means for controlling the amount of air inducted into said engine; fuel supply means for controlling the fuel supply to said engine, said fuel supply means being responsive to the target torque value; throttle valve control means for controlling the position of said engine throttle valve, said throttle valve control means being responsive to said target torque value; and means for modifying the operation of one said fuel supply control means and said throttle position control means to compensate for the air flow characteristics within said induction passage.

DETAILED DESCRIPTION OF THE PREFERRED EMBODIMENTS

Figure 1:
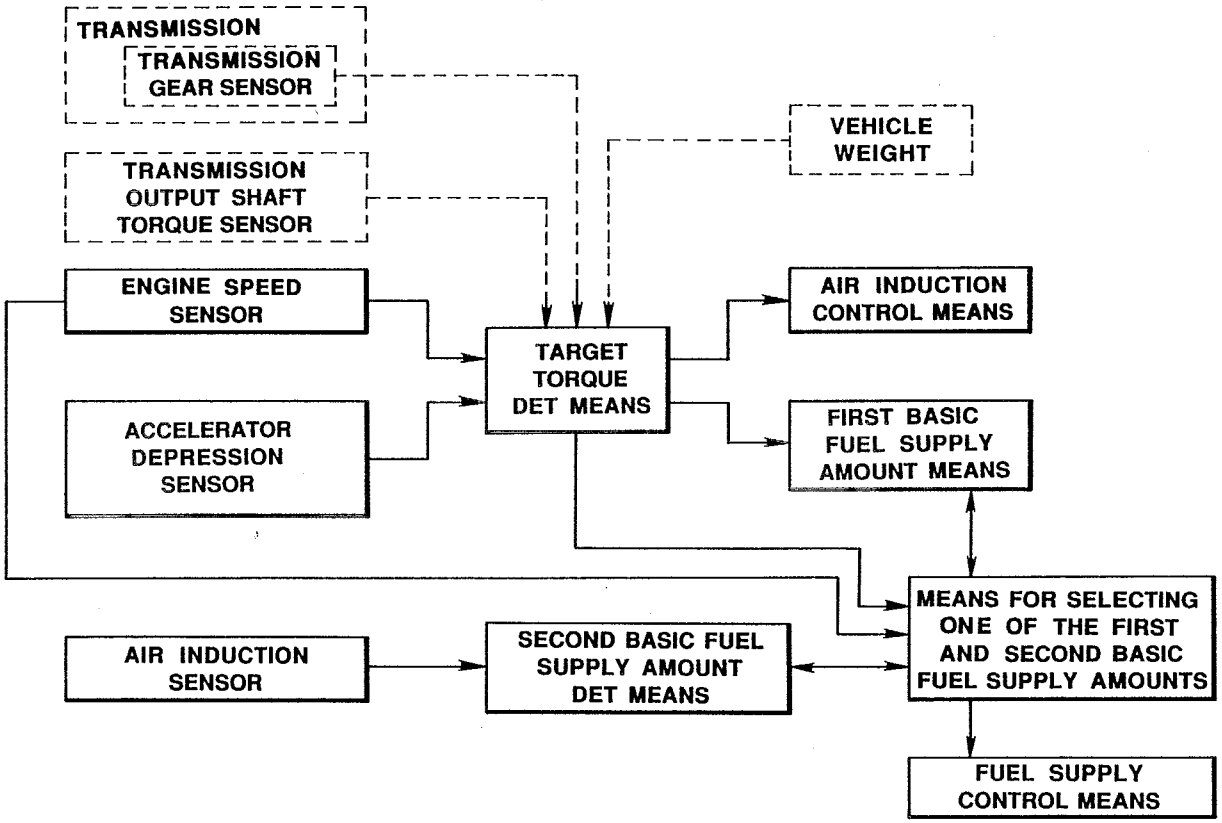
FIG. 1 is a block diagram which demonstrates the conceptual arrangement of a system according to the first and fifth embodiments of the present invention.

FIG. 1 shows the conceptual arrangement of the present invention in schematic block diagram form.

Figure 2:
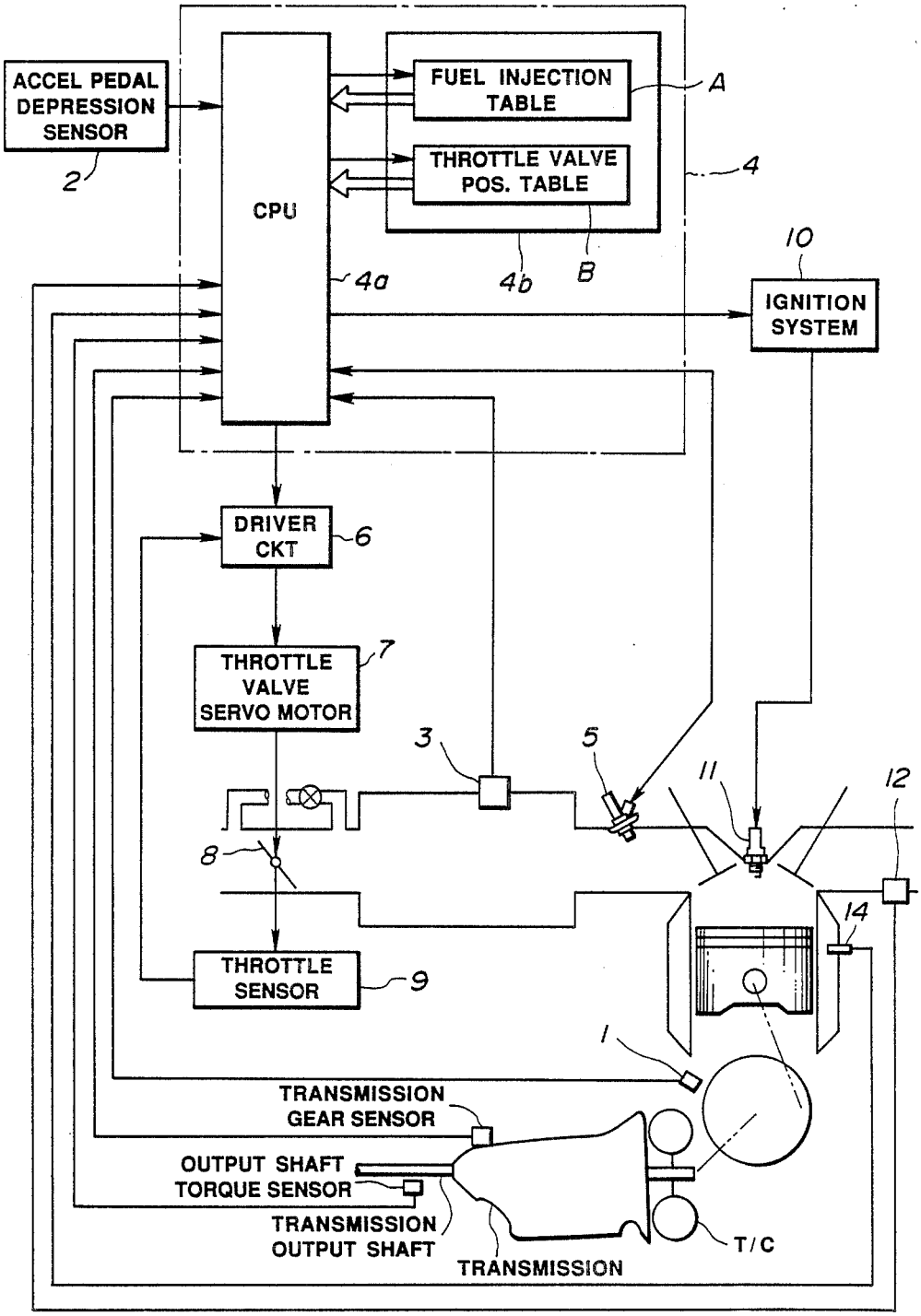
FIG. 2 is a schematic type diagram showing an engine system to which the embodiments of the present invention are applied.

FIG. 2 shows in schematic block diagram form, an engine system to which the embodiments of the present are applied.

In this system, a crank angle sensor 1 is operatively connected with the crankshaft of the engine and arranged to output a pulse train signal from which the engine speed can be determined. An accelerator pedal depression sensor 2 is operatively connected to an accelerator pedal or corresponding piece of equipment. In this case, sensor 2 takes the form of a potentiometer which is arranged to generate a signal indicative of the displacement or degree by which the pedal is depressed.

An air induction sensor 3 is disposed in the induction system and arranged to produce an output indicative of the amount of air being inducted into the engine. In the illustrated arrangement this sensor takes the form of so called "boost" or induction pressure sensor which detects the pressure Pa prevailing in the induction system.

A control unit 4 which includes a microprocessor, is operatively connected with the sensors 1–3 and arranged to receive the data inputs therefrom. For simplicity of explanation, only the CPU 4*a* and the ROM 4*b* are shown. However, as will be appreciated the device inherently includes an input/output interface or interfaces, RAM, A/D units, buses and the like hardware.

The ROM 4*b* contains pre-memorized map data. The first of these maps is recorded in terms of engine speed and accelerator depression degree and enables a target torque value To (and the necessary basic injection pulse width theoretically required to achieve the To value) to be looked up based on the inputs from the sensors 1 and 2.

A second map B recorded in the ROM contains data which enables the necessary throttle opening degree Øo which will ensure that the amount of air required to achieve the target torque To is admitted to the engine, to be derived.

Depending on the target torque value To, the control unit 4 is arranged to elect whether to use the basic injection pulse width Tp derived by look up, or to use the induction pressure data to derive the same. Following the election, the control unit uses the selected value to derive the actual injection pulse width Ti and then applies the same with a predetermined timing to the electromagnetically controlled injector valve 5.

The control unit 4 is arranged to output a control signal to a servo driver circuit 6 based on the data derived via the look-up using table B. The driver circuit 6 is operatively connected with a servo motor 7 which controls the position of a throttle valve 8.

A throttle position sensor 9 is arranged to sense the actual opening degree ØR of the throttle valve 9 and is connected with the driver circuit 6 in a manner which defines a feed-back control loop.

For the sake of explanation only, the control unit 4 can be deemed to include means for determining a target torque value; means for producing first and second basic injection pulse widths; means for controlling the supply of fuel to the engine; and means for determining the amount of fuel supplied to the engine. The control unit 4 further includes means for determining the ignition timing of the engine based on the input from the crank angle sensor 1 and supplying a control signal to engine ignition system 10. This system in turn supplies a high voltage to the spark plug 11 at suitable timing.

The illustrated engine system further includes an exhaust gas sensor 12 which produces a signal indicative of the air-fuel ratio of the A/F mixture being combusted in the combustion chamber, an engine coolant temperature sensor 14, a transmission gear position sensor and a transmission output shaft torque sensor. The reason for the provision of these sensors will become more apparent hereinlater.

Figure 3:
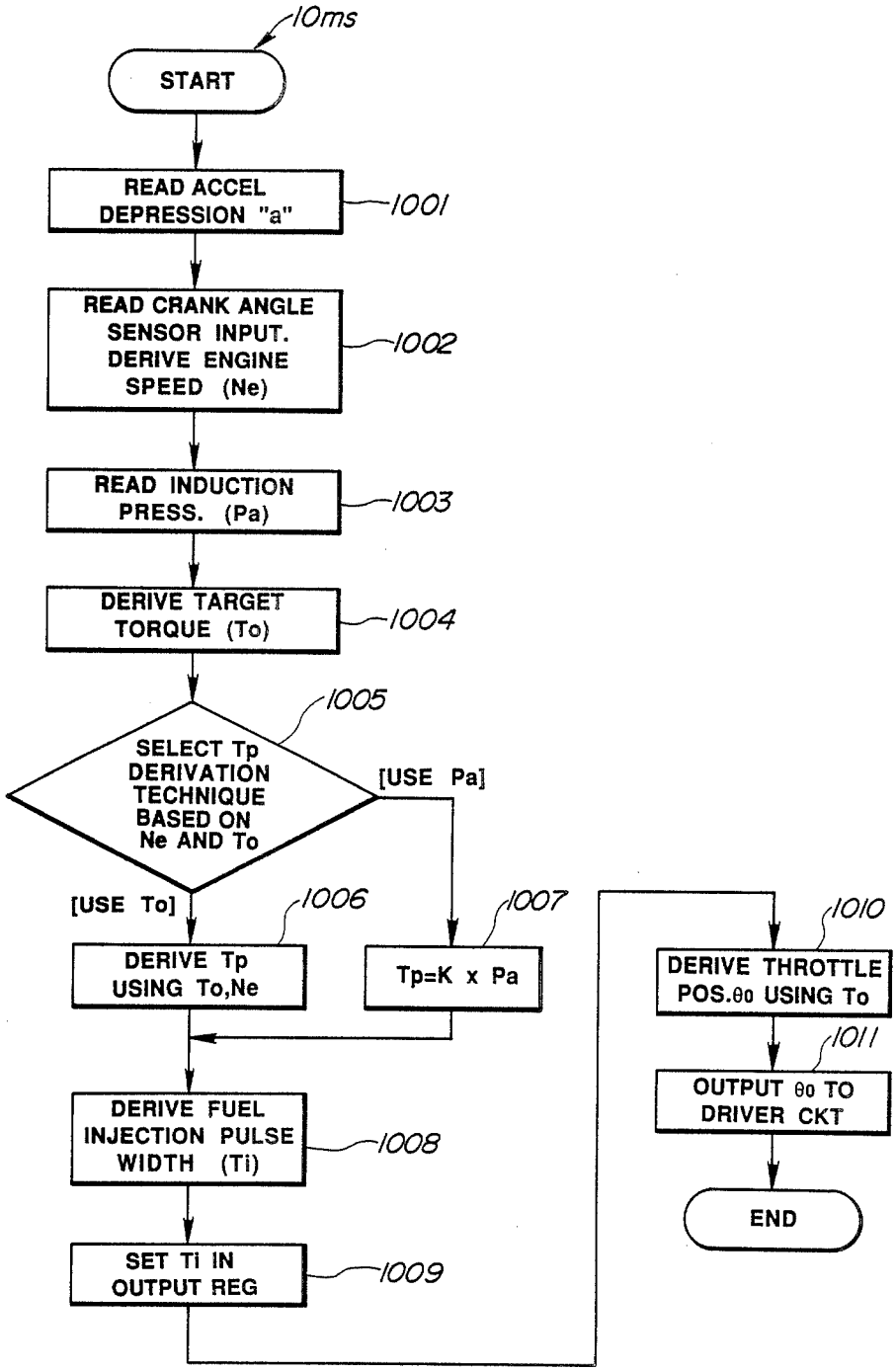
FIG. 3 is a flow chart depicting the steps which characterize the operation of a first embodiment of the present invention.

FIG. 3 is a flow chart which depicts the steps which characterize the operation of the first embodiment of the present invention. Merely, by way of example the instant routine is arranged to be run a predetermined intervals of the order of 10 ms.

In step 1001, the input from the acceleration pedal depression sensor 2 is read and the degree 'a' to which the pedal is depressed is determined. The instant 'a' value is compared with that recorded on the previous run and the amount of work done on the accelerator pedal calculated. In step 1002, the output of the crank angle sensor 1 is read and the engine speed Ne determined. This determination can be carried out by counting the number of pulses produced per unit time or suitably determining the frequency of the pulses using other known techniques. Following this, the output of the boost sensor is read and the pressure prevailing in the induction system downstream of the throttle valve is determined in step 1003.

At step 1004 the amount of torque which is required for the instant set of driving conditions is determined.

In the instant embodiment this determination includes the use of an accelerator depression/torque output ratio factor K1 and an engine speed/torque output ratio factor K2.

The magnitudes of these factors are determined with respect to a plurality of parameters which include the weight of the vehicle, the gear transmission associated with the engine, is conditioned to produce, and the torque which is applied to the output shaft of the transmission. As will be appreciated some of this data can be obtained by reading the outputs of the transmission gear sensor and the output shaft torque sensor.

The vehicle weight can be determined either by memorizing the weight of the vehicle in the ROM (this weight can be the empty weight or a weight which is adjusted to include one or more passengers). Alternatively, in the event that the vehicle suspension includes means for determining the amount by which the shock absorbers, springs etc are compressed, the instant weight of the vehicle including passengers and luggage can be estimated. By way of example only the capacitance displacement sensor/shock absorber combination as disclosed in U.S. Pat. No. 4,788,489 issued on Nov. 29, 1988 in the name of Kobayahsi et al.

In this instance the total weight of the vehicle could be derived using the following equation:

$$W = Wo + 1/k \quad [1]$$

where:

Wo is the unladen weight of the vehicle;

l is the amount of compression of the vehicle suspension springs as detected by a sliding resistance, capacitance variation or the like type of stroke/displacement sensor arrangement; and k is the spring constant of the vehicle suspension spring which is associated with the displacement sensor.

By way of example, it is possible to derive K1 by taking a basic predetermined K1 value (viz., k1b) and modifying it using the following equation:

$$K1 = K1b \times W/m \quad [2]$$

where m is the instant gear ratio.

Similarly, it is possible to obtain K2 by taking a basic predetermined value K2b and using the following equation:

$$K2 = K2b \times W/m^2 \quad [3]$$

Once the required data is obtained and the appropriate values of K1 and K2 determined the following equation is used to derive the target torque value:

$$To = K1 \times a - K2 \times Ne \quad [4]$$

It should be noted that, in the event that it is not required to determined the To value with respect to the instant set of driving conditions with the above mentioned precision, then it is alternatively possible to simply use the Ne and 'a' values to determine the value using a table look-up technique.

At step 1005 the Ne value derived in step 1002 and the To value derived in step 1004 are used to calculate a basic fuel injection pulse width Tp.

Figure 4:
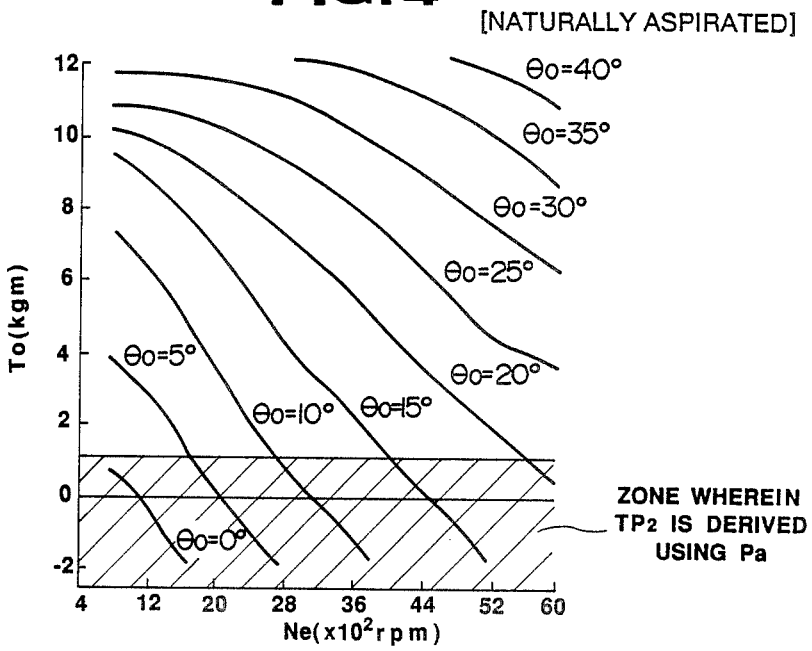
FIGS. 4 and 5 are graphs which depict tabled data which is used in connection with the first and fifth embodiments of the present invention.
Figure 5:
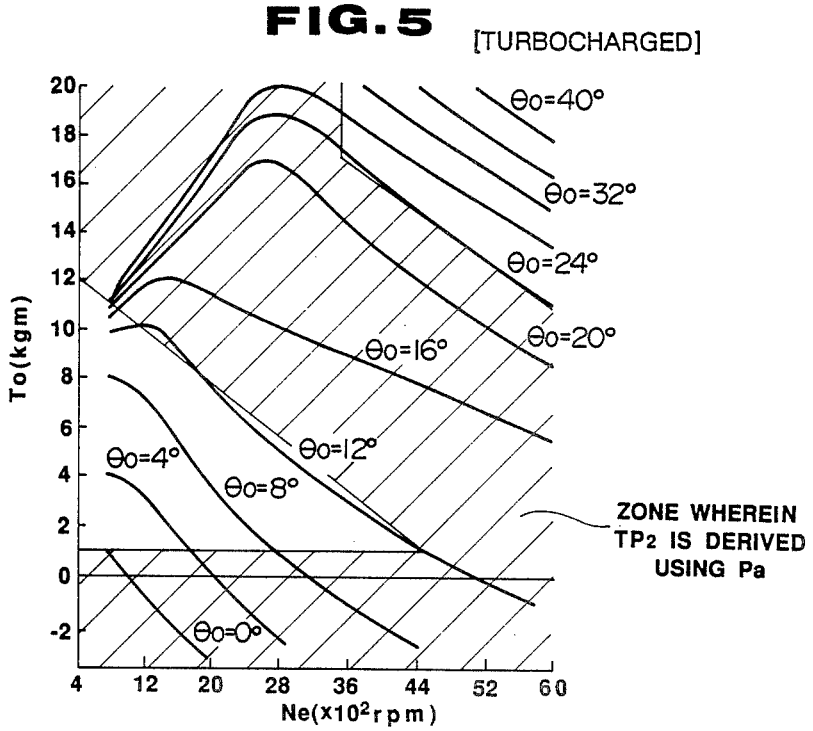

Using the table data depicted in FIGS. 4 or 5 it is possible to determined that a first basic injection pulse width Tp1 should be determined if the To and Ne coordinates fall in a non-hatched area while a second basic pulse width Tp2 should be determined in the event that the coordinates fall within a hatched zone. It should be noted that the data shown in FIG. 4 is used in the case of naturally aspirated engines while the data in FIG. 5 is used for engines which are supercharged by a exhaust gas driven turbocharger. By way of example only, the hatched zone in FIG. 4 denotes a mode of operation when the induction pressure reaches a level whereat the air is by-passed about the throttle valve 8 via a by-pass passage (no numeral).

As will be appreciated under these conditions, the position of the throttle valve no longer accurately represents the actual air induction quantity and even thought it may be accurately set to a position which should be suited to the instant set operating conditions the amount air being inducted deviates from that which the system indicates.

In the case of turbocharged engines due a so called turbolag phenomoenon wherein the boost in induction pressure (as detected by sensor 3) inevitably occurs a time after the accelerator pedal depression which induces the same, has occurred. The data shown in FIG. 5 has been developed to take this delay into account.

Accordingly, in the event that the outcome of step 1005 is such as to indicated that the To and Ne coordinates fall in a non-hatched zone, the routine flows to step 1006. On the other hand, if the coordinates fall in a hatched area, the routine flows across to step 1007.

Figure 6:
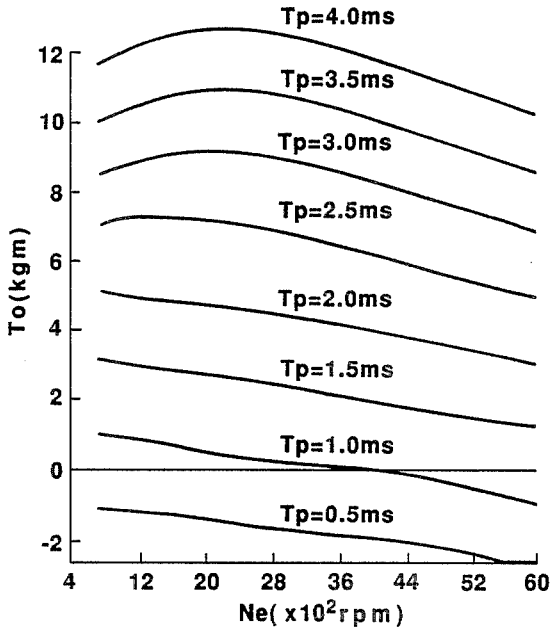
FIG. 6 and 7 are graphs which depict tabled data which is used in connection with the first and fifth embodiments of the present invention.

In step 1006 the values of To and Ne derived in steps 1002 and 1004 are used in combination with injection control data of the nature depicted in FIG. 6. As will be appreciated, the appropriate injection pulse width (Tp1) for the instant set of To and Ne conditions can be read off directly as the amount of air being by-passed under these conditions is zero.

On the other hand, at step 1007 as air is being permitted to flow through the by-pass passage, the basic injection pulse width (in this instance the second basic injection pulse width Tp2) is derived using the following equation:

$$Tp = k \times Pa \quad [5]$$

wherein k is a constant which represents the characteristics of the instant engine. As will be appreciated, the above equation is extremely basic and induction air temperature and/or other correction factors can additionally included if so desired.

In the instant embodiment the so called D-Jetronic injection control technique which utilizes induction pressure as a control parameter is employed. However, the present invention is not so limited and it is within the scope of the same to provide a suitable hot wire type air flow meter (or the like) and alternatively utilize the so called L-Jetronic technique.

For further information relating to the manner in which the actual injection pulse width can be calculated reference can be has to U.S. Pat. No. 4,712,529 issued on Dec. 15, 1987 in the name of Terasaka et al.

With the instant embodiment, as the decision as to which technique to use to derive the basic injection pulse width can be made via a simple comparison; and while the To and Ne coordinates remain in a non-hatched zone, the ability to look-up the appropriate value, the load on the microcomputer CPU is effectively reduced.

At step 1008 the actual injection pulse width Ti is derived by suitably correcting and modifying the basic value derived in the previous steps using the engine coolant temperature, the feed back information derived from the exhaust gas sensor 12 and the like.

It will be noted that the present invention is not limited to the use of MPI type injection systems wherein injectors are located immediately upstream of each of the engine cylinders and the a SPI system wherein a single injector is located well upstream of the cylinders. Depending on the type of system involved the type of calculation which is performed in order to derive Ti will vary a little. However, as this is well with the purview of one skilled in the art to which the instant invention pertains, further discussion of this aspect of the invention is deemed unnecessary.

Figure 7:
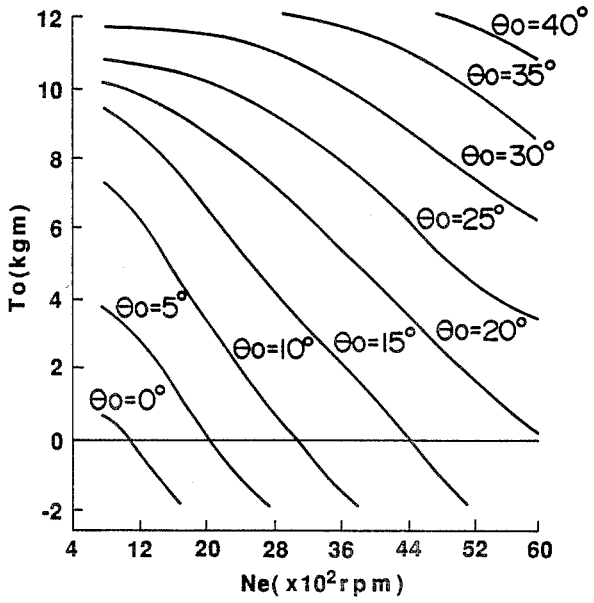

In step 1009 this value is set in an output register and at step 1010 the position to which the throttle valve should be set under the instant set of operating conditions (viz., the target throttle position Øo) is determined. This determination involves the use of the data which is depicted in FIG. 7. As will by appreciated, using the values of To and Ne which have been obtained, the target throttle position opening Øo value can be looked up. The value Øo derive in step 1010 is outputted to the driver circuit 6 in step 1011. In response to this the driver circuit 6 feed-back controls the operation of the servo motor 7 until such time as the actual throttle position ØR and the target value Øo determined in step 1011, coincide.

With the present invention even when the engine is provided with a supercharging device such as a turbocharger, the precision with which fuel is supplied to the engine is improved and this is not limited to naturally aspirated engines alone.

SECOND EMBODIMENT

Figure 8:
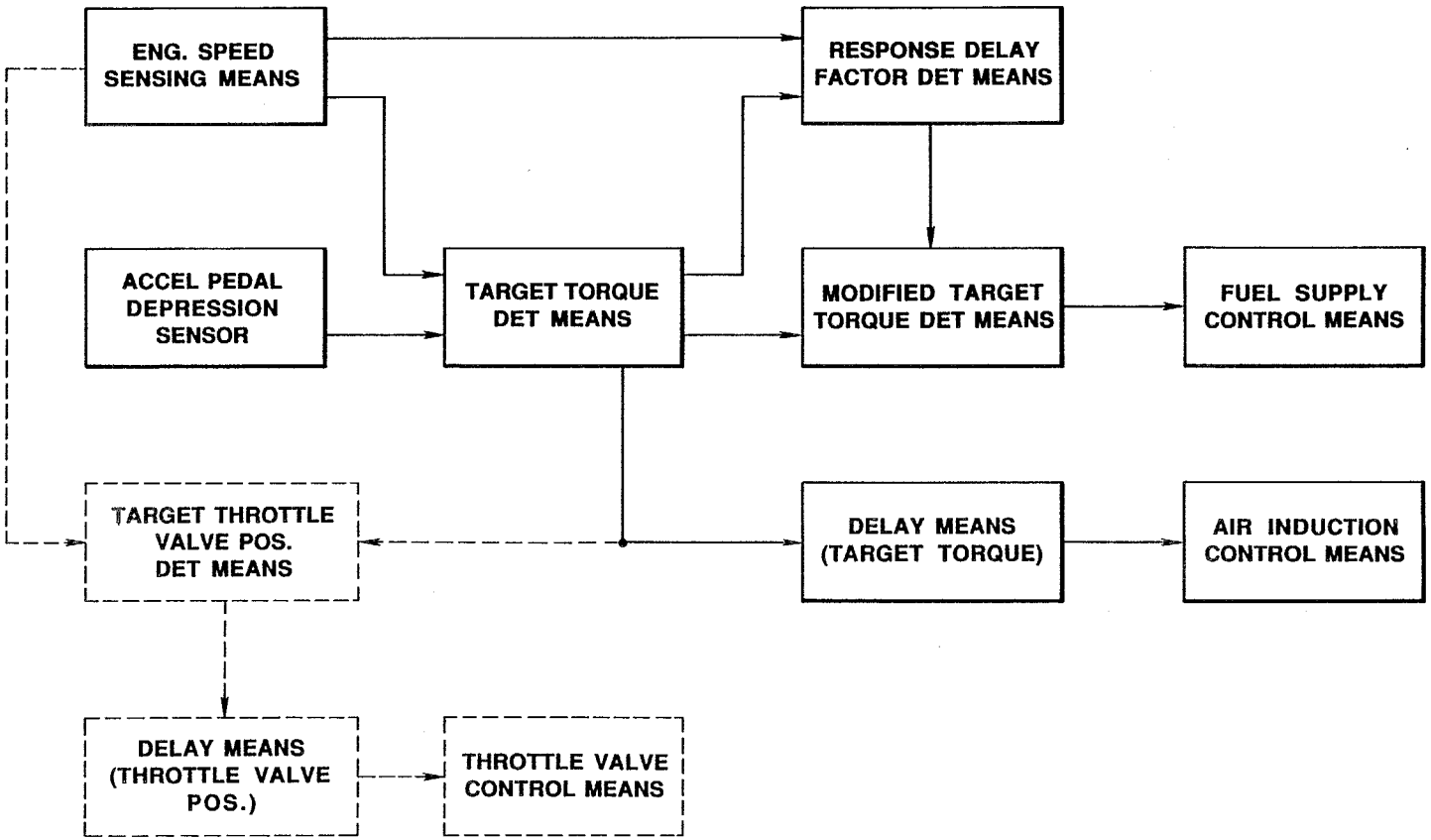
FIG. 8 is a block diagram showing the concept on which second to fourth embodiments of the present invention are generally based.

FIG. 8 shows in block diagram form, the concept on which a second embodiment of the present invention is based. As will become more apparent as a description of the same proceeds, this embodiment features an arrangement which takes the delay between the actual depression of the accelerator pedal and the corresponding change in the amount of air which is inducted into the engine cylinder or cylinders, into account. In brief, the second embodiment is such as to determine a target torque value; determine the delay in the induction air flow characteristics which will occur based on the target torque value; develop a modified torque value which represents the amount of torque which can be realistically produced by the engine in view of the air flow delay; control the fuel supply based on the modified torque value; and control the air flow based on a value of the target torque which was recorded predetermined time prior the instant induction phase.

It should be noted that the second embodiment is applied to an engine system which, in terms of hardware, is essentially similar to that shown in FIG. 2.

Figure 9:
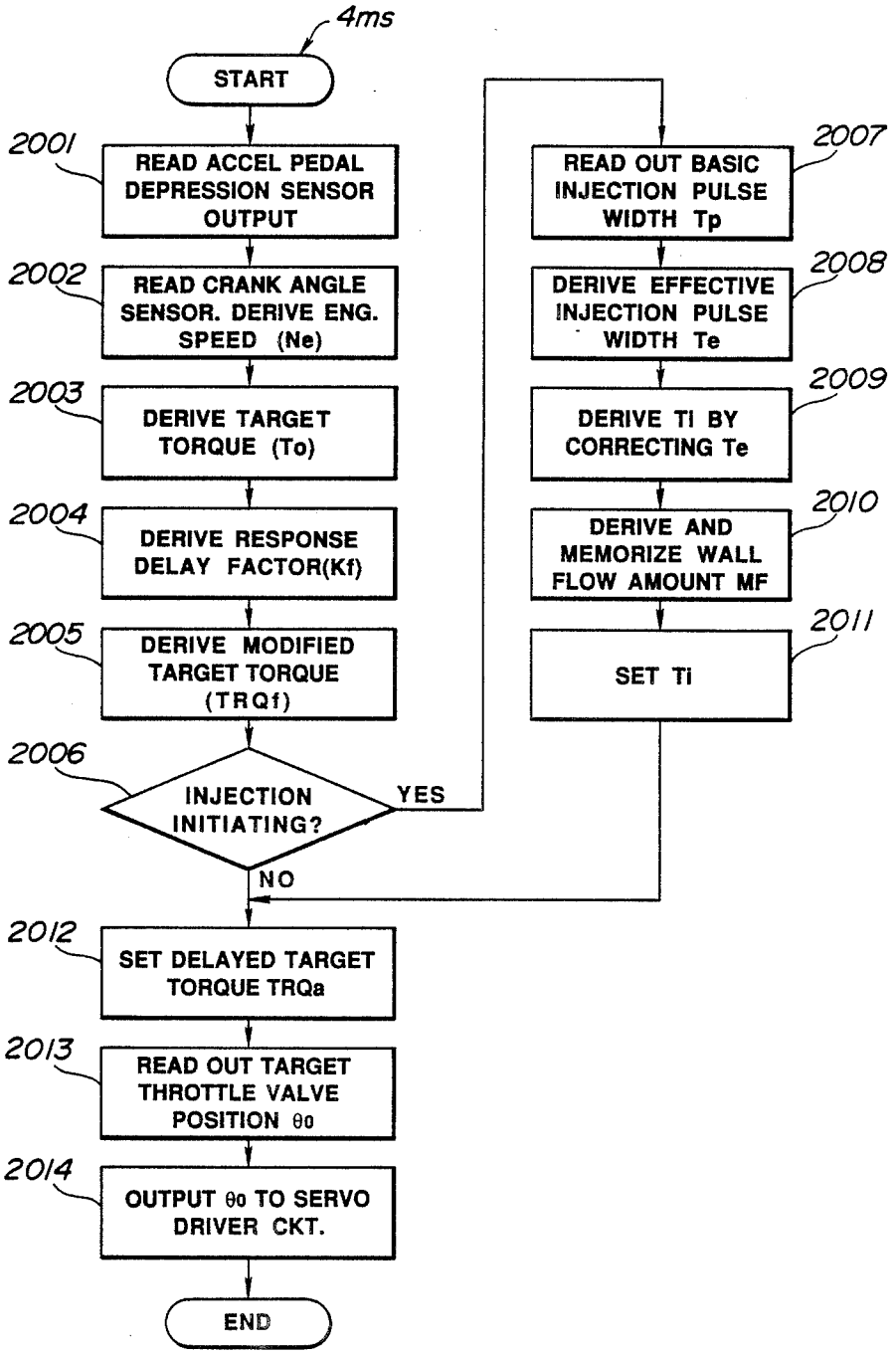
FIG. 9 is a flow chart showing the steps which characterize the operation of a second embodiment of the present invention.

FIG. 9 shows in flow chart form, the operations which characterize this embodiment. The routine depicted in this figure is arranged to be run at 4 ms intervals (by way of example).

At step 2001 the output of the accelerator pedal depression sensor 2 is read and recorded. At step 2002 the output of the crank angle sensor is read and the instant engine speed is calculated. At step 2003 the target torque value is derived and the result of this calculation is set in a FIFO memory (viz., a first in first out type memory). In this instance the technique via which the To value is derived is essentially the same as that used in the first embodiment.

At step 2004 a response delay factor kf which is indicative of the delay with which the air flow in the collector of the induction system changes is derived based on a response time dely factor $\tau f$ which varies with the ramming effect within the collector. In this instance the derivation of the response delay factor is based on the changes in the sampled pressure values. As the value of the response delay time factor $\tau f$ varies with both engine speed and load, this value is derived via a table look-up technique using the instant throttle valve opening and engine speed values Øo, Ne.

At step 2005 the most recently derived target torque value To and the kf value derived in step 2004 are used to derive what shall be referred to as a modified torque value TRQf. This derivation is carried using the following equation:

$$TRQfnew = kf \times TRQfold + (1 - kf) \times To \quad [6]$$

In the above equation 'new'and 'old'denote the values of TRFQ which were derived during the instant run and the previous run, respectively.

Figure 10:
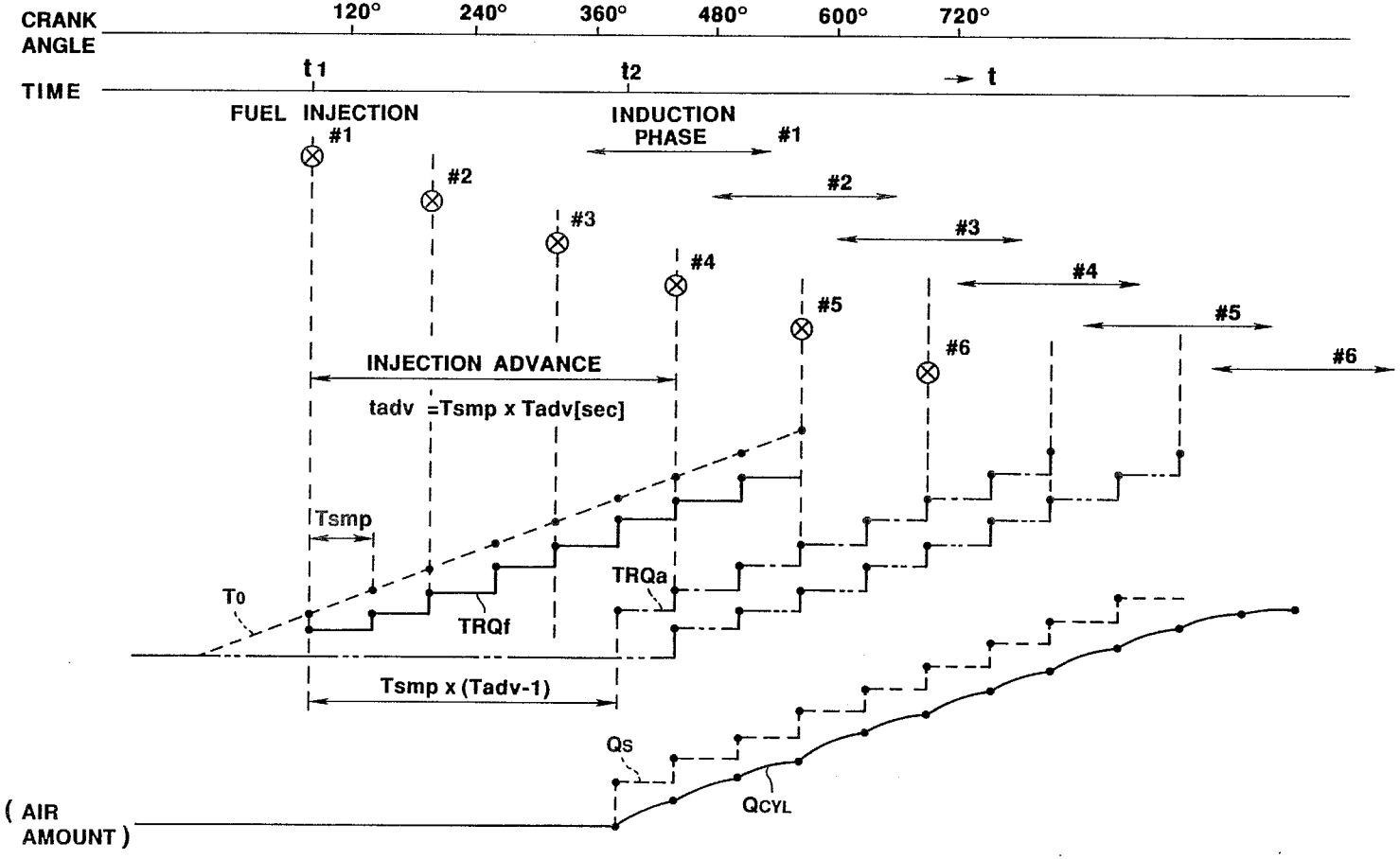
FIG. 10 is a timing chart showing the timing with which various control parameters of the second embodiment are developed.

With this arrangement, even if the accelerator pedal position is suddenly changed resulting in a corresponding change in the target torque To, the change in modified target torque varies corresponds to a large extent with the air flow characteristics (see FIG. 10).

At step 2006 the injection timing of the engine is examined and it is determined if the injection for a given cylinder is initiating or not.

In the event that an injection is initiating then the routine flows to steps 2007 wherein a basic injection pulse width Tp is derived. This derivation utilizes the values of Ne and TRQf which have been previously obtained and tabled data of the nature shown in FIG. 11. In step 2008 the Tp value is corrected in a manner which takes the temperature of the engine coolant as indicated by sensor 14 and the air-fuel ratio of the exhaust gases as indicated by the feed back from the exhaust gas sensor 12, into account and which adds a correction value for various other influences. In accordance with this correction a value Te is obtained At step 2009 a wall flow variable MF and a wall flow correction factors æ, $\beta$ are applied according to the following equation:

$$Ti = (Te - \beta \times MFcyl)/æ \quad [7]$$

At step 2010 the amount of fuel flowing on walls of the induction passage is calculated in preparation for the next run of the program. In this instance the calculation is performed using the following equation:

$$MFcyl = (1æ \times Tiold + (1 - \beta) \times MFcylold \quad [8]$$

Figure 11:
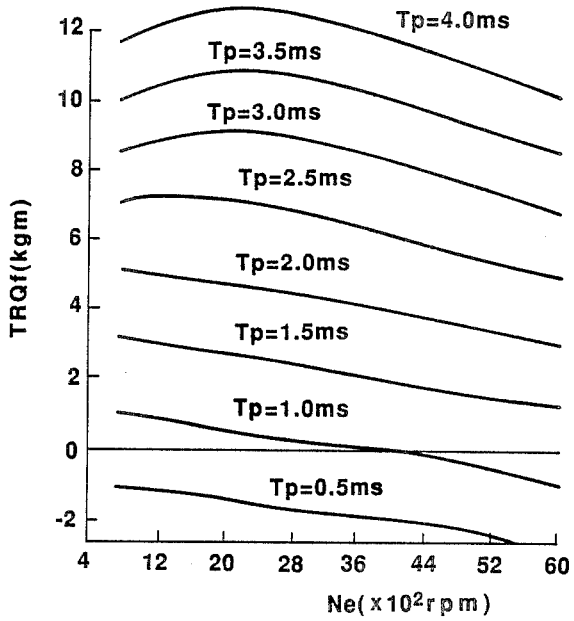
FIGS. 11 and 12 are graphs which depict tabled data used in connection with the second fourth embodiments of the present invention.

Alternatively, it is possible as the engine speed and temperature effect this value, to read a TRQf value out of a table of the nature shown in FIG. 11 and correct this using the A/F feedback information from the exhaust gas sensor 12. It is further possible to record both of the instant Ti and MF values and use these during the calculations on the next run of the control routine.

At step 2011 the finalized value of Ti is set and used to control injection.

At step 2012 a previously recorded value of To (viz., Tadv−1) is read out of memory and used derive what shall be referred to as a delayed target torque value TRQa.

It will be noted that in this instance:

tadv denotes the time at which injection is initiated prior the corresponding induction phase;

Tadv is the sampled value of To;

Tadv−1 denotes the Tadv value used in the previous run of the instant control routine; and Tsmp is the frequency at which the To value is sampled.

It will also be noted that in the instant embodiment the frequency Tsmp with the target torque is sampled is the same as the frequency with which the control routine is run.

As will be noted from FIG. 10 at time t2 TRQa is derived Viz.:

$$TRQa = Tsmp \times (Tadv - 1) \quad [9]$$

Due to the relatively high frequency with which the instant routine is run, it will be noted that:

$$\text{tadv} \approx \text{Tsmp} \times \text{Tadv} \quad [10]$$

Figure 12:
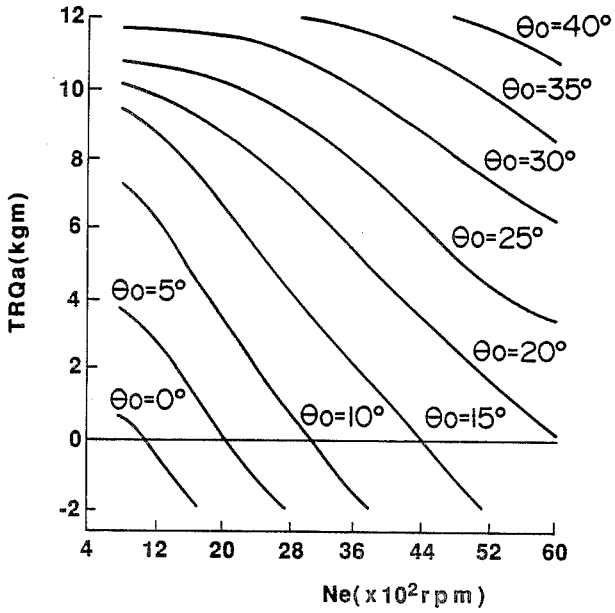

At step 2013 the just derived value of TRQa is used in combination with the instant engine speed Ne to look-up a target throttle valve opening position Øo using tabled data of the nature depicted in FIG. 12. At step 2014 the Øo value is sent to the servo driver circuit 6 which in turns induces the appropriate operation of the throttle valve servo motor 7.

In order to ensure the desired supply of fuel and the formation of the appropriate air/fuel mixture in each of the combustion chambers of the engine, the injection for each cylinder is initiated at point in time which is adequately advanced with respect to the induction phase of the respective cylinder. It is of course within the scope of the present invention to vary the injection advance timing in accordance with various engine operation parameters.

As indicated above the point in time at which the injection is initiated is given by:

$$tadv = Tsmp \times Tadv \quad [11]$$

As will be noted in FIG. 10, the value of To increases proportionally as indicated by the chain line trace. Further as will be understood from the previous disclosure Qcyl denotes the amount of air which is inducted into each of the cylinders, while Qs denotes the amount of air which passes through the throttle chamber in which the throttle valve 8 is disposed. Due to the periodic sampling, the TRQf, TRQa and Qs traces are stepped.

As disclosed above in connection with step 2013, at time t2 the target throttle opening Øo is derived based on the TRQa torque value and a suitable control applied to the throttle valve servo driver circuit 6. Due to the delay in the change in air flow in the collector of the induction system actually reaching the cylinders of the engine relationship between Qcyl and Qs is such that:

$$\frac{Qcyl(s)}{Qs(s)} = \frac{1}{1 + \tau f \times s} \quad [12]$$

where $\tau f$ is the previously mentioned response time dely which varies with the ramming effect within the collector of the induction system.

It will be noted that this value can be varied depending on the driving conditions. Viz., as it tends to vary with the engine speed Ne and the throttle valve setting which is derived based on the target torque To value, it is possible to derive a fixed value for each type of engine induction system. Alternatively, it is possible to calculate the same using the Ne and Øo values which are made available during the running of the routine.

By way of example, $\tau f$ can be derived using the following equation:

$$\tau f = \frac{Vc}{R \times Ta} \times \frac{1}{\frac{\eta v \times VE \times \gamma a}{2 \times Pa} \times N + C \times g \times \phi} \quad [13]$$

wherein:

Vc is the collector volume;

R is the gas constant;

Ta is the induction air temperature;

Pa is the ambient air pressure;

$\eta$v is the flow efficiency;

VE is the displacement of the engine;

$\gamma$a is the air density;

C is a throttle opening degree factor;

g is a factor which is dependent on the induction pressure.

It will be understood that the amount of air being inducted into the engine is indicative of the amount of torque being produced by the engine. Accordingly, using the Qcyl and Qs parameters it is possible to determine the delay with which the desired amount of torque will be output. Accordingly, it will be understood that the delay between the TRQa and TRQf values will be related in the same manner.

Therefore, it can be shown that the relationship between Qs and Qcyl and TRQa and TRQf is the same. It is therefore possible, by using the sampling frequency (time available for calculation) Tsmp, to develop the following equation:

$$\frac{TRQf(z)}{TRQa(z)} = \frac{1 - e^{-Tsamp/\tau f}}{z - e^{-Tsmp/\tau f}} \quad [14]$$

It is then possible to modify the above expression by using a weighted mean technique to express TRQf as follows:

$$TRQfnew = kf \times TRQfold + (1 - kf) \times TRQa \quad [15]$$

where kf is a factor which is related to the throttle opening or the target torque and the engine speed, and which can be expressed as follows:

$$kf = e - Tsmp/\tau f \quad [16]$$

As will be appreciated, in order to achieve the desired TRQf value, it is essential for the required amount of fuel to be inducted during the respective induction phases. For this reason the injection is initiated with a predetermined advance timing tadv. However, it should be noted that with the present invention it is not absolutely essential that the injection timing be adjusted, just the torque which will actually be produced be predictable. For this reason it is possible to predict the TRQf value for any give in induction phase solely on the basis of the tadv value.

Once having predicted TRQf it is sufficient that the delay with which the amount of air which passes through the throttle chamber (viz., Qs) be delayed via derivation from the TRQa value.

That is to say, the derivation of amount of torque which can be feasibly produced by the engine (viz., TRQf) is conducted by reading out the target torque value To with the delay of one sampling frequency (viz., Tadv−1) while the derivation of delayed value of To (viz., TRQa) is obtained from the product of Tsmp×(Tadv−1)

Once having the TRQa value the calculation of TRQfnew can be conducted.

Put in another way, with the instant embodiment, assuming that for a given cylinder the injection timing, the amount of accelerator pedal depression 'a' and the engine speed are all established then instead of using this most recent To value to determine how much fuel and air will actually be inducted during the induction phase associated with the injection, a To value is equal to Tsmp ×(Tadv−1) is set as TRQa and used on one hand to delay the throttle valve opening in a manner which will suitably effect the amount of air which is inducted, while the injection amount is set using a value TRQf which is indicative of the amount of torque which can be practically expected to be produced and which is based on a target torque value which was set in memory one sampling period before.

Under these conditions the amount of air and fuel which will be supplied during the induction phase will be in accordance with the TRQf value and will produce the required air/fuel ratio.

As will be appreciated from the above, as there is a time between the injection and the actual start of the induction phase associated with said injection, it is possible to use the delay to predict the amount air which will be inducted and thus enable the calculation of the fuel injection amount. Further, it is possible to derive a target torque value on a cylinder to cylinder basis and to control the setting of the throttle valve in a manner which takes the delay required for the flow characteristics in the collector into account.

THIRD EMBODIMENT

Figure 13:
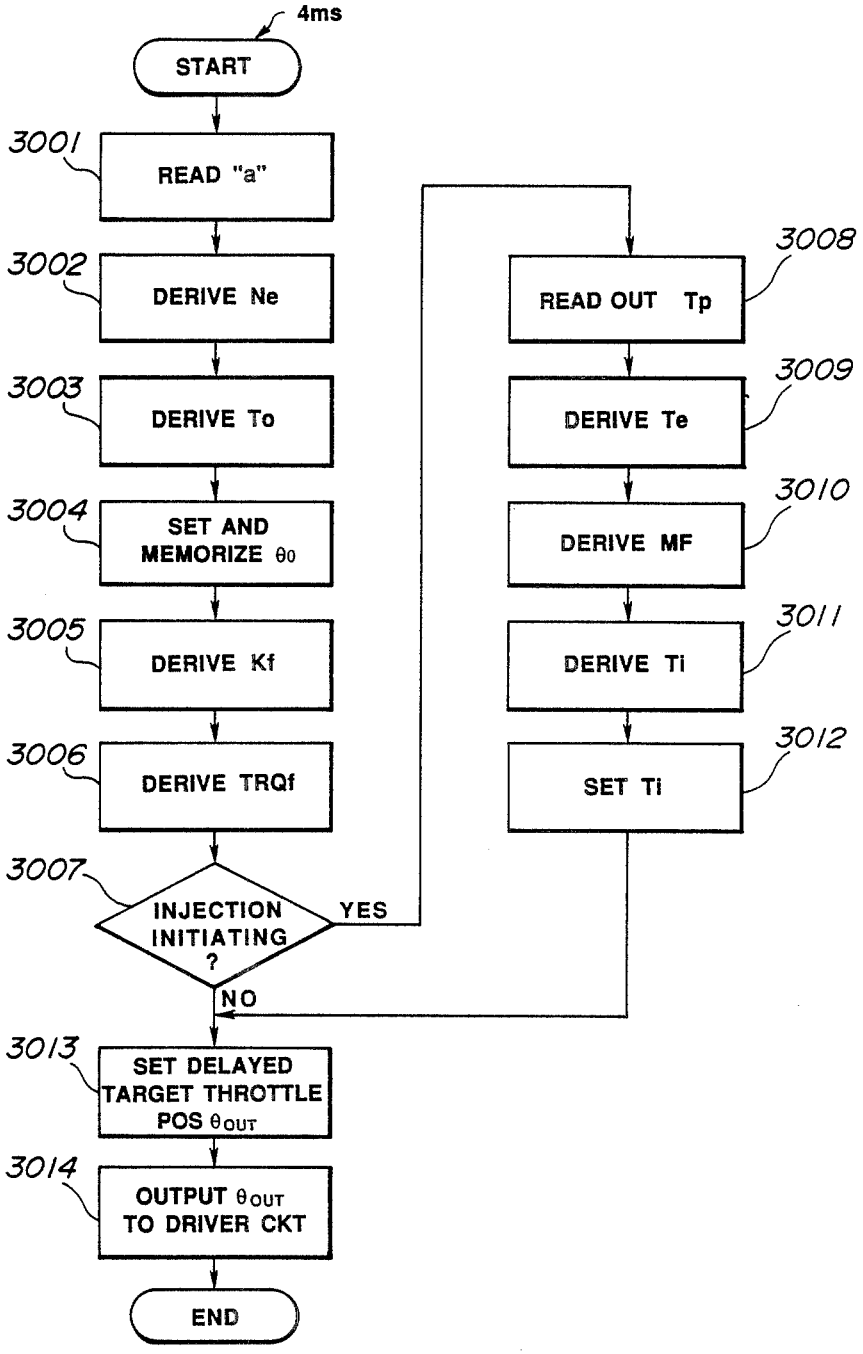
FIG. 13 is a flow chart showing the steps which characterize the operation of a third embodiment of the present invention.

FIG. 13 shows the steps which characterize the operation of a third embodiment of the present invention. As will be appreciated, steps 3001 to 3004 are such as to read the accelerator depression amount 'a', derive the engine speed Ne from the input from the crank angle sensor, derive the target torque To for the instant 'a' and Ne values, and set and store the target throttle opening value Øo, all in a manner similar to that conducted in the second embodiment. In this instance the derivation of the throttle opening value Øo can be carried using tabled data of the nature depicted in FIG. 7.

In steps 3005 a value of kf is obtained and at step 3006 a TRQf value is derived by reading out a (Tadv−1) value from memory.

Steps 3007 to 3012 are essentially the same as step 2006 to 2011 shown in FIG. 9.

At step 3013 a value of TRQa is developed using Tsmp×(Tadv−1) and used to look-up a target throttle position value Øo.

As will be appreciated, this embodiment is essentially the same as the second one and differs in that the TRQf value is developed before the injection status is investigated.

It should be further noted that although the second and third embodiments are such as to control the operation of the throttle valve servo motor 7 with a signal which has already been modified with the appropriate time delay, it is within the scope of the present invention to supply the target torque and required time delay data to the throttle valve driver circuit 6 and to delay the throttle setting which should be implemented therein.

FOURTH EMBODIMENT

Figure 14:
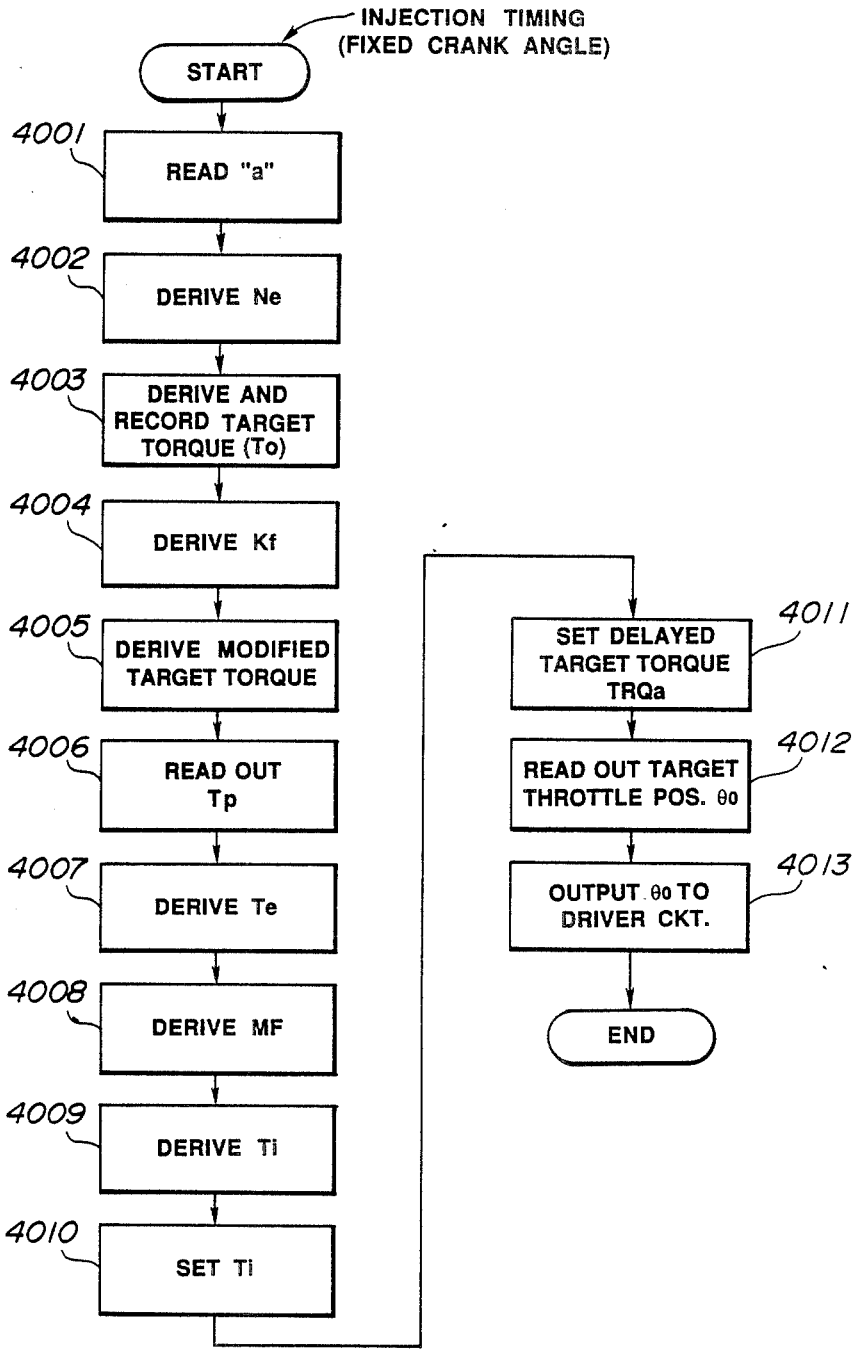
FIG. 14 is a flow chart showing the steps which characterize the operation of a fourth embodiment of the present invention.

FIG. 14 shows a flow chart which depicts the operations which characterize a fourth embodiment of the invention. This embodiment is arranged so that the injection timing is not checked and following the derivation of the modified target torque value TRQf at step 4005, the control routine according to the fourth embodiment proceeds through the steps of reading out a value of Tp, modifying this value to obtain a Te value, determining MF and then deriving Ti.

At step 4011 of this routine, an (Aadv−1) value is read out of the To data stored in memory. In this case, this value is the target torque value which was derived and set in memory on the previous run of the routine. In this embodiment, this value is used to determine the delayed torque value TRQa. In this instance the Aadv value in the case of a 6 cylinder engine, cylinders 2–5 are such that Aadv×the crank angle over which the injector is open, closely approaches the value which is defined from the injection timing to the induction phase and can be used to derive the delayed torque value TRQa.

It will be noted that in this embodiment as injections can occur simultaneously, the sampling frequency can be derived in the following manner.

$$Tsmp = \frac{60}{Ne(\text{rpm})} \times \frac{2}{\text{cyl number } n} \qquad [17]$$

The value of TRQf which was derived at step 4005 and the kf value are used in step 4011 with the sampling frequency Tsmp to derive a value of TRQa.

Figure 15:
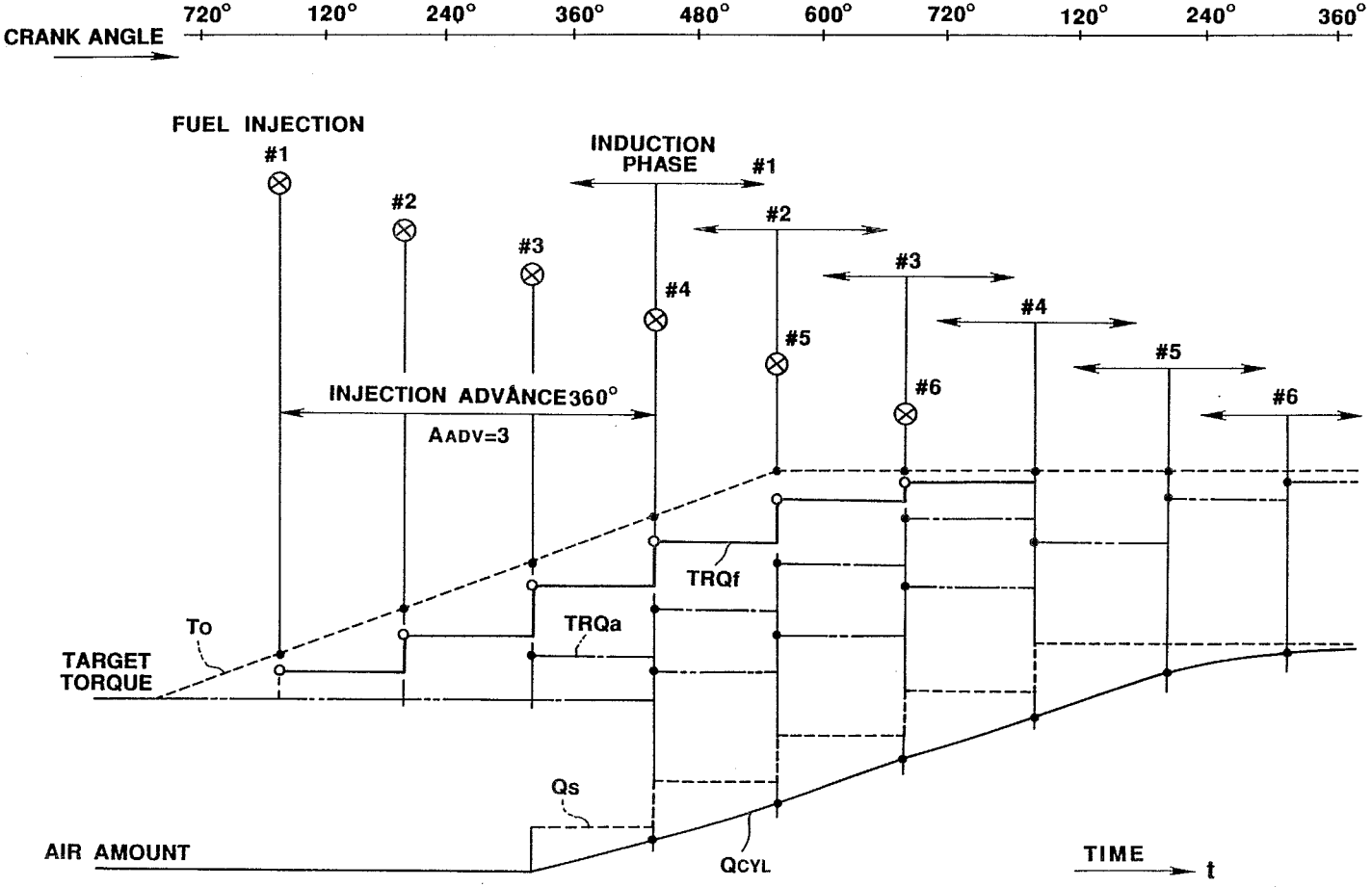
FIG. 15 is a timing chart showing the timing with which various control parameters of the fourth embodiment are developed.

FIG. 15 is a timing chart which shows the control characteristics which are obtained using the control depicted in the flow chart of FIG. 14. As will be appreciated in this instance the sampling frequency becomes the time required for a 120° rotation of the engine crank shaft.

It should be noted that, as shown in FIG. 15, Aadv is 3. Further, it is possible that group injection control can be applied as injections for a plurality of cylinders are executed at the same time.

In this manner, as shown in the flow chart of FIG. 14 even through the control of the fourth embodiment is such that the gap between the injection timing and the induction phase is determined in terms of crank angle, and the injection amount and air flow control are based on this, the same effect as achieved with the third embodiment, is produced, and it is possible to achieve the same desirable control as produced with the previously discussed embodiments.

FIFTH EMBODIMENT

Figure 16:
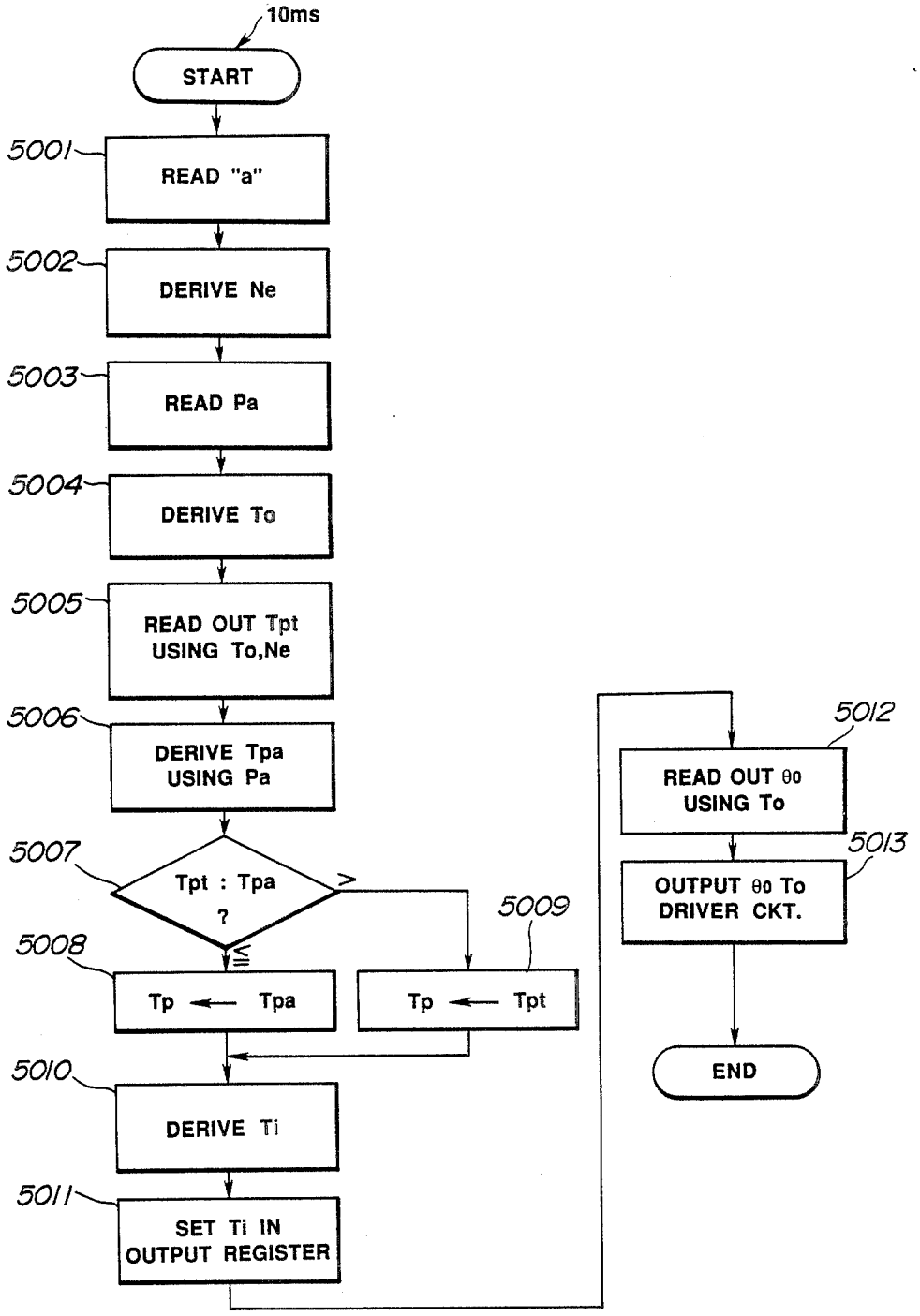
FIG. 16 is a flow chart showing the steps which characterize the operation of a fifth embodiment of the present invention.

FIG. 16 shows a flow chart which depicts the control steps which characterize a fifth embodiment of the present invention. In this embodiment which is similar to the first one, the control routine is arranged to be run at 10 ms intervals. In steps 5001 to 5003 the accelerator pedal depression 'a' is read, engine speed Ne derived and the output of the induction pressure sensor 3 read.

At step 5004 a target torque value To is derived. In this instance, the derivation is essentially the same as that conducted in connection with step 1004 of the control routine of the first embodiment shown in FIG. 3.

At step 5005 the values of To and Ne are used in connection with tabled data in order to read out a first or primary basic fuel injection pulse width Tpt.

At step 5006 the induction pressure reading recorded in step 5003 is used to derive a second basic injection pulse width using the following equation $$Tpa = k \times Pa \quad [18]$$

where k is a constant which varies with the induction characteristics of the engine. This value may be further modified using factors indicative of the effect of engine temperature and the like, if so desired.

The instant embodiment employs the so called D-Jetronic type injection control wherein the induction pressure is used as a control parameter. However, it is within the scope of the present invention to add hot wire type air flow meter at a location upstream of the throttle chamber and employ the so called L-Jetronic type control if so desired.

At steps 5007 the values of Tpt and Tpa are compared and the larger of the two is set as the instant basic injection pulse width Tp upon which the injection control will be based. At step 5010 the larger of the two values is used to derive a Ti value. It will be understood that the derivation of this value is the same as that discussed in connection with previous embodiments.

Following this, the Ti value is set in an output register and at step 5012 the To and Ne data obtained in steps 5002 and 5004 is used in connection with tabled data of the nature shown in FIG. 7 todderive a target throttle valve opening value Øo. A signal indicative of this value is fed to the driver circuit 6 associated with the throttle valve servo motor 7.

The fifth embodiment is such at low engine load when the throttle valve is closed and the amount of air which permitted to flow through the throttle chamber is very small, even when the by-pass passage opens and permits air to be by-passed about the throttle valve, the effect of this by-passed air is compensated for. Viz., the throttle valve position is used under all conditions to determine the target torque value, while the amount of fuel which is supplied to the engine is determined by the larger of two pulse widths, one which is based on the throttle opening and the other which is based on the induction pressure. When the by-pass passage opens the pulse width which is based on the induction pressure becomes larger than the one based on the throttle valve position. As the system automatically switches away from the throttle valve position dependent pulse width to one which is induction pressure dependent, any undesirably deviation from the intended air-fuel ratio is prevented.

In the case the engine is provided with a supercharger as the correlation between the throttle position and the amount of air which is supplied to the engine cylinders tends to lost, the ability of the fifth embodiment to select between the two basic injection pulse widths based on which is larger, the control of the air-fuel ratio is maintained. This feature tends to find particular benefit in the case of turbocharged engines wherein there is inevitably a delay between the depression of the accelerator pedal and the development of the pressure boost.

In the case of naturally aspirated engines, during engine braking and engine idling the loss of air-fuel ratio is securely prevented in the under such conditions the pressure dependent injection pulse width becomes larger than that based on throttle position and super lean mixtures which invite HC emission producing engine misfiring is prevented.

As will be appreciated the fifth embodiment is such as to be readily applicable to both supercharged and naturally aspirated engines without the need for modification.

What is claimed is:

1. An internal combustion engine control system comprising:

an engine speed sensor;

accelerator pedal depression sensor;

target torque determining means responsive to said engine speed sensor and said accelerator pedal depression sensor for determining a target torque value;

air induction control means responsive to said target torque determining means for controlling the amount of air inducted into said engine;

means for determining a first basic fuel supply amount based on the target torque value;

an air induction sensor for sensing the amount of air inducted into the engine;

means responsive to the air induction sensor for determining a second basic fuel supply amount;

selection means for selecting one of the first and second basic fuel supply amounts; and fuel supply means for supplying the selected fuel supply amount to the engine.

2. An internal combustion engine control system as claimed in claim 1 wherein said selection means selects the larger of the first and second basic fuel supply amounts.

3. An internal combustion engine control system as claimed in claim 1 wherein said selection means comprises:

engine control data which is recorded in terms of engine speed and target torque, said data being divided into first and second zones; and means for:

determining which zone the engine speed and target torque coordinates fall in;

selecting said first basic fuel injection supply amount if the engine speed and target torque coordinates fall in said first zone, and selecting said second basic fuel injection supply amount if the engine speed and target torque coordinates fall in said second zone.

4. An internal combustion engine control system for an engine having an induction system, comprising:

an engine speed sensor;

accelerator pedal depression sensor;

first means responsive to said engine speed sensor and said accelerator pedal depression sensor for determining a target torque value;

means for determining an air induction delay factor based on the engine speed, the target torque value and the induction characteristics of the engine induction system;

means for determining a first modified target torque value which represents the torque which can actually be produced by the engine based on the target torque value and the air induction delay factor;

means responsive to the first modified torque target value for controlling the amount of fuel supplied to the engine;

means for producing a delayed target torque value, said delayed target torque value comprising said target torque value which is issued with a delay of a time defined between the timing of the supply of fuel to the engine and the induction phase; and air induction control means for controlling the amount of air which is inducted into the engine in response to said delayed target torque value producing means.

5. An internal combustion engine control system for an engine having an induction system, comprising:

an engine speed sensor;

accelerator pedal depression sensor;

first means responsive to said engine speed sensor and said accelerator pedal depression sensor for determining a target torque value;

means for determining an air induction delay factor based on the engine speed, the target torque value and the induction characteristics of the engine induction system;

means for determining a first modified target torque value which represents the torque which can actually be produced by the engine based on the target torque value and the air induction delay factor;

means responsive to the first modified torque target value for controlling the amount of fuel supplied to the engine;

a throttle valve disposed in the induction system of the engine;

means for setting a target throttle valve opening degree based on the target torque value and producing a throttle valve opening degree control signal; and means for delaying the issuance of the target throttle valve opening degree signal by the time defined between the fuel supply timing and the induction phase; and a throttle valve opening control means for controlling the opening degree of said throttle valve in response to the delayed throttle valve opening control signal.

6. An internal combustion engine control system as claimed in claim 4 wherein said delayed target torque value producing means comprises:

means for modifying a target torque value by a time factor which varies with the time defined between a time at which fuel is supplied into said engine for a given induction phase and the given induction phase, to develop said delayed target torque value; and means for deriving a target throttle opening value based on the delayed target torque value, said target throttle opening value being used to control said air induction control means.

7. In an internal combustion engine means for determining the engine speed and the amount depression of an accelerator pedal;

means for determining a target torque value based on the engine speed and accelerator pedal depression;

means for determining a delay in the induction air flow which will occur in based on said target torque value;

means for modifying the target torque value using the determined air flow delay and developing a modified torque value which represents the amount of torque which can actually be expected to be produced by the engine in view of the air flow delay;

means for controlling the fuel supply based on the modified torque value; and means for controlling the air flow based on a value of the target torque which was recorded a predetermined time before.

8. In an internal combustion engine having a throttle valve and fuel supply means:

means for sampling the engine speed and the amount depression of an accelerator pedal at predetermined intervals;

means for determining a target torque value based on the engine speed and accelerator pedal depression samples;

means for recording the target torque values;

means for using a target torque which was recorded one sampling period before as a modified target torque value;

means for controlling the fuel supply based on the modified torque value;

means for using a target torque value which was recorded a plurality of sampling periods before as a delayed target torque value; and means for controlling the position of said throttle valve in accordance with said delayed target torque.

9. In an internal combustion engine:

means for determining the engine speed and the amount depression of an accelerator pedal;

means for determining a target torque value based on the engine speed and accelerator pedal depression;

means for determining a delay in the induction air flow which will occur, based on said target torque value;

means for modifying the target torque value using the determined delay and developing a modified torque value which represents the amount of torque which can actually be expected to be produced by the engine in view of the air flow delay;

means for controlling the fuel supply based on the modified torque value;

means for modifying the target torque value with a time factor so as to develop a delayed target torque value; and means for controlling the position of the throttle valve in accordance with the delayed target torque value.

10. In a method of controlling an internal combustion engine, the steps of:

determining the engine speed and the amount depression of an accelerator pedal;

determining a target torque value based on the engine speed and accelerator pedal depression;

determining a delay in the induction air flow which will occur in based on said target torque value;

modifying the target torque value using the determined delay and developing a modified torque value which represents the amount of torque which can actually be expected to be produced by the engine in view of the air flow delay;

controlling the fuel supply based on the modified torque value; and controlling the air flow based on a value of the target torque which was recorded a predetermined time before.

11. In a method of controlling an internal combustion engine having a throttle valve and fuel supply means, the steps of:

sampling the engine speed and the amount depression of an accelerator pedal at predetermined intervals;

determining a target torque value based on the engine speed and accelerator pedal depression samples;

recording the target torque values;

using the target torque which was recorded one sampling period before as a modified target torque value;

controlling the fuel supply based on the modified torque value;

using a target torque value which was recorded a plurality of sampling periods before as a delayed target torque value; and controlling the position of said throttle valve in accordance with said delayed target torque.

12. In a method of controlling an internal combustion engine, the steps of:

determining the engine speed and the amount depression of an accelerator pedal;

determining a target torque value based on the engine speed and accelerator pedal depression;

determining a delay in the induction air flow which will occur based on said target torque value;

modifying the target torque value using the determined delay and developing a modified torque value which represents the amount of torque which can actually be expected to be produced by the engine in view of the air flow delay;

controlling the fuel supply based on the modified torque value;

modifying the target torque value with a time factor so as to develop a delayed target torque value; and controlling the position of the throttle valve in accordance with the delayed target torque value.

13. In a method of controlling an internal combustion engine, the steps of:

sensing engine speed;

sensing the amount of depression of an accelerator pedal;

determining a target torque value based on the sensed engine speed and accelerator pedal depression amount;

determining a first basic fuel supply amount based on the target torque;

sensing an induction parameter which varies with the amount of air being inducted into the engine;

determining a second basic fuel supply amount based on the sensed parameter; and selecting one of said first and second basic fuel supply amounts based on one of:

a combination of the engine speed and the target torque, and a magnitude of said induction parameter.

14. An internal combustion engine control system comprising:

an induction passage;

an engine throttle valve disposed in said induction passage for controlling the flow of air therethrough;

an engine speed sensor;

accelerator pedal depression sensor;

target torque determining means responsive to said engine speed sensor and said accelerator pedal depression sensor for determining a target torque value;

air induction control means responsive to said target torque determining means for controlling the amount of air inducted into said engine;

fuel supply means for controlling the fuel supply to said engine, said fuel supply means being responsive to the target torque value;

throttle valve control means for controlling the position of said engine throttle valve, said throttle valve control means being responsive to said target torque value; and means for modifying the operation of one said fuel supply control means and said throttle position control means to compensate for the air flow characteristics within said induction passage.

* * * * *